US010145150B2

(12) United States Patent
White

(10) Patent No.: US 10,145,150 B2
(45) Date of Patent: Dec. 4, 2018

(54) PADLOCKABLE SECURITY COLLARS HAVING HINGE CONNECTED COMPONENTS

(71) Applicant: Franklin B White, Ft. Pierce, FL (US)

(72) Inventor: Franklin B White, Ft. Pierce, FL (US)

( * ) Notice: Subject to any disclaimer, the term of this patent is extended or adjusted under 35 U.S.C. 154(b) by 21 days.

(21) Appl. No.: 15/330,336

(22) Filed: Sep. 8, 2016

(65) Prior Publication Data

US 2017/0101809 A1 Apr. 13, 2017

Related U.S. Application Data

(63) Continuation-in-part of application No. 29/505,301, filed on Sep. 8, 2015, now Pat. No. Des. 775,511, and a continuation-in-part of application No. 29/505,712, filed on Jan. 12, 2016, now abandoned.

(60) Provisional application No. 62/283,696, filed on Sep. 8, 2015, provisional application No. 62/387,969, filed on Jan. 12, 2016.

(51) Int. Cl.
*E05B 67/38* (2006.01)
*E05B 73/00* (2006.01)

(52) U.S. Cl.
CPC ..... *E05B 67/38* (2013.01); *E05B 67/383* (2013.01); *E05B 73/00* (2013.01)

(58) Field of Classification Search
CPC ..... E05B 67/38; E05B 67/383; E05B 73/00
USPC ..... 70/18, 175–180, 423–428, 455, 14, 19, 70/58
See application file for complete search history.

(56) References Cited

U.S. PATENT DOCUMENTS 14,956 A * 5/1856 Ells
256,079 A * 4/1882 Trackwell
D16,541 S * 2/1886 Bunker
999,983 A * 8/1911 Gardner
1,065,103 A * 6/1913 Baum et al. ..... B60R 25/02113 280/89
1,348,960 A * 8/1920 Saegesser ..... B60R 25/093 70/18
1,353,117 A * 9/1920 Thompson ..... B60R 25/093 70/18
1,359,213 A * 11/1920 Welch ..... B60R 25/02147 70/18
1,401,971 A * 1/1922 Faison ..... B60R 25/09 70/15
1,449,913 A * 3/1923 Russell ..... B62D 43/02 224/42.25
1,483,687 A * 2/1924 Shepard ..... B60R 25/093 70/18

(Continued)

*Primary Examiner* — Lloyd A Gall
(74) *Attorney, Agent, or Firm* — David A. Burge

(57) ABSTRACT

Padlockable security collars are disclosed that each include a chain of elongate, in-series, hinge-connected components that are configured to cooperatively wrap and perimetrically shroud relatively movable elements of so-called "connection assemblies" and the like that have relatively movable members which need to be shrouded and protectively enclosed to prevent unauthorized operation. Holes that can be aligned to permit a shackle of a padlock to extend therethrough are formed through opposite end regions of each security collar's chain of components so the security collar can be locked in place once a compartment-defining component receives, shrouds and protectively encloses the relatively movable members that need to be prevented from being moved or operated while the security collar is locked in place.

9 Claims, 14 Drawing Sheets

(56) References Cited

U.S. PATENT DOCUMENTS 1,530,814 A * 3/1925 Credle ..... F16K 35/10 70/178
1,780,994 A * 11/1930 Caldwell ..... F16K 35/10 70/178
3,283,608 A 11/1966 Davis et al. ..... 74/527
3,532,111 A * 10/1970 Gaglio ..... F16K 35/10 137/385
3,665,738 A * 5/1972 Pescuma ..... B60R 25/023 70/211
3,811,303 A * 5/1974 Robertson ..... B60R 25/023 200/43.22
4,020,662 A * 5/1977 Fowler ..... B60R 25/023 200/43.22
D247,423 S * 3/1978 Kaplan ..... 180/287
D248,447 S * 7/1978 Hornung ..... D8/354
4,104,895 A * 8/1978 Tankel ..... B60R 25/023 180/287
4,134,279 A * 1/1979 Ross ..... B60R 25/023 70/18
4,187,706 A * 2/1980 Hill ..... B60R 25/023 70/424
D270,610 S 9/1983 Kinard, Jr. ..... D8/4
4,570,470 A * 2/1986 Gray, Sr. ..... E05B 13/001 70/212
D283,486 S 4/1986 Fogel ..... D8/396
4,598,562 A * 7/1986 Freeman ..... B60R 25/023 70/237
4,614,403 A 9/1986 Kersten ..... G02B 7/023 359/818
4,627,514 A * 12/1986 Brown ..... B60R 25/023 180/287
4,726,207 A * 2/1988 Gifford ..... B60R 25/023 70/237
4,828,300 A 5/1989 Agbay ..... H02B 1/03 220/319
4,955,215 A * 9/1990 Eremita ..... B60R 25/023 70/18
5,212,970 A * 5/1993 Harrell ..... B60R 25/018 70/18
5,291,762 A * 3/1994 Fornaro ..... B60R 25/023 70/18
D358,017 S 5/1995 Clark ..... D99/99
5,461,891 A * 10/1995 Noel ..... B60R 25/0221 70/18
5,544,505 A * 8/1996 McIntosh ..... E05B 67/383 70/14
5,560,235 A * 10/1996 Aucoin ..... E05B 13/001 70/163
D378,659 S 4/1997 Blennov ..... D8/396
5,642,635 A 7/1997 Wen-Chyun ..... E05B 67/28 70/227
D384,267 S * 9/1997 Giles ..... D8/346
D389,442 S * 1/1998 Kantor ..... D12/162
5,806,350 A * 9/1998 Savinsky ..... B60R 25/023 70/169
5,806,555 A * 9/1998 Magno, Jr. ..... E05B 13/00 137/385
5,826,448 A * 10/1998 Graham ..... B60R 25/023 70/18
D411,440 S 6/1999 Stahel ..... D8/396
5,927,111 A * 7/1999 Nachbauer ..... F16K 35/10 137/382
D420,569 S 2/2000 Evans ..... D8/382
D540,158 S 4/2007 Smith ..... D8/396
D546,666 S 7/2007 Mohlin ..... D8/396
D559,095 S 1/2008 Lalancette ..... D8/396
D559,671 S 1/2008 Baxter ..... D8/395
7,650,767 B2 1/2010 Robinson ..... G01R 11/04 292/256.6
D682,660 S 5/2013 Aldrich ..... D8/330
D692,294 S 10/2013 Koeniger ..... D8/396
D711,730 S 8/2014 McKiernan ..... D8/396
D719,012 S 12/2014 Alexander ..... D8/346
D742,213 S 11/2015 Sasanecki ..... D8/396
D775,511 S * 1/2017 White ..... D8/336
2007/0227206 A1 10/2007 Stone ..... 70/232

* cited by examiner

PADLOCKABLE SECURITY COLLARS HAVING HINGE CONNECTED COMPONENTS

REFERENCE TO TWO RELATED PROVISIONAL APPLICATIONS

This application claims the benefit of the filing date of each of the following TWO provisional applications, namely:

1) Provisional Application Ser. No. 62/283,696 filed Sep. 8, 2015 by Franklin B. White, the disclosure of which is incorporated herein by reference; and, 2) Provisional Application Ser. No. 62/387,969 filed Jan. 12, 2016 by Franklin B. White, the disclosure of which is incorporated herein by reference.

REFERENCE TO TWO RELATED NON-PROVISIONAL APPLICATIONS

This application is also a continuation-in-part of each of two presently pending design applications, namely:

1) Design application Ser. No. 29/505,301 filed Sep. 8, 2015 by Franklin B. White, the disclosure of which application is incorporated herein by reference; and 2) Design application Ser. No. 29/505,712 filed Jan. 12, 2016 by Franklin B. White, the disclosure of which application is incorporated herein by reference.

FIELD OF THE INVENTION

The present invention relates to padlockable security collars designed to perimetrically wrap, shroud and protectively enclose various types of sensitive assemblies that have relatively movable members that need to be shrouded and prevented from being moved or operated for relatively lengthy periods of time.

So-called "connection assemblies" constitute examples of such sensitive assemblies having a compact set of relatively movable members that need to be shrouded, protectively enclosed and prevented from being operated once the relatively movable members have been set so the sensitive assembly can perform its intended function.

BACKGROUND

Many types of sensitive assemblies have compact sets of relatively movable members that need to be prevented from being moved or operated for lengthy periods of time, once the relatively movable members have been carefully set. So-called connection assemblies constitute one example of these sensitive assemblies.

Some of these so-called "connection assemblies" are commercially available. Others are formed from such components as may be readily at hand. The connection assemblies serve not only to reliably couple costly units and devices to upstanding supports and masts, but also provide a compact arrangement of relatively movable elements that can be operated quickly and easily to attach and detach costly units and devices from upstanding supports and masts.

One well known and widely used commercially available connection assembly is known as a "Tri-Bracket connection assembly" which is depicted in FIG. 8 of the present document, where the Tri-Bracket assembly is indicated by the letter "C." The Tri-Bracket assembly is also shown in FIGS. 7 and 8 of utility application Ser. No. 14/544,686 which was published on Aug. 27, 2015 as publication number 2016/0240988. The disclosures of the Tri-Bracket assembly found in the aforementioned application and publication are incorporated herein by reference.

Not all "connection assemblies" are commercially available units—for many are constructed from materials that can be found at hand—an example being a clamping-type of connection assembly that is indicated by the numeral 700 in FIGS. 22, 23 and 26 of the present document.

SUMMARY OF THE INVENTION

The present invention relates to padlockable security collars that each consist of a chain of hinge-connected, generally elongate components arranged end to end in a series that can be installed to perimetrically surround a sensitive assembly, with one of the elongate components defining a compartment that opens and faces toward the sensitive assembly to receive, shroud and protectively enclose relatively movable members of the sensitive assembly to prevent the movable members from being moved or operated.

When a security collar is installed to shroud and protectively enclose relatively movable members of a particular sensitive assembly, the components of the security collar are said to be in a closed position when they perimetrically surround the sensitive assembly. When the components of the security collar are moved to an open position, the security collar can be removed from perimetrically surrounding the sensitive assembly.

When a security collar embodying features of the present invention is installed so that its chain of components surrounds a sensitive assembly, AND when the one component of the security collar that defines a compartment is positioned to receive the relatively movable members that need to be shrouded and protectively enclosed to prevent being moved or operated, holes that are formed through components that define opposite end regions of the chain of components can be aligned to receive a shackle of a padlock so the security collar can be locked in place in its installed position.

In preferred practice, the particular component of a security collar's chain of components that defines the compartment is one of the two components that defines opposite end regions of the chain of components.

However, in preferred practice, if the security collar is formed by a total of three elongate components, then the particular component that defines the compartment is a component that extends between the two components that define opposite end regions of the chain of elongate components.

In preferred practice each chain of elongate components that defines a security collar has at least one arcuately curved component that bulges away from an interior region that is surrounded by the security collar when the components are in the closed position perimetrically surrounding the interior region.

In preferred practice, the arcuately curved component referred to just above is one of the two components that define opposite end regions of a security collar that includes the arcuately curved component.

In preferred practice, the arcuately curved component defines an arcuate curve that is a segment of an imaginary circle that has a length at least as long as one fourth of the circumference of the imaginary circle.

In preferred practice, if a security collar includes more than two elongate components, then the components that define opposite end regions of the security collar each include an arcuate curve that bulges away from an interior region that is surrounded by the security collar when in the closed position.

BRIEF DESCRIPTION OF THE DRAWINGS

Other features and advantages of the invention will become apparent from the description and claims that follow, taken together with the accompanying drawings, wherein:

DETAILED DESCRIPTION

Figure 6:
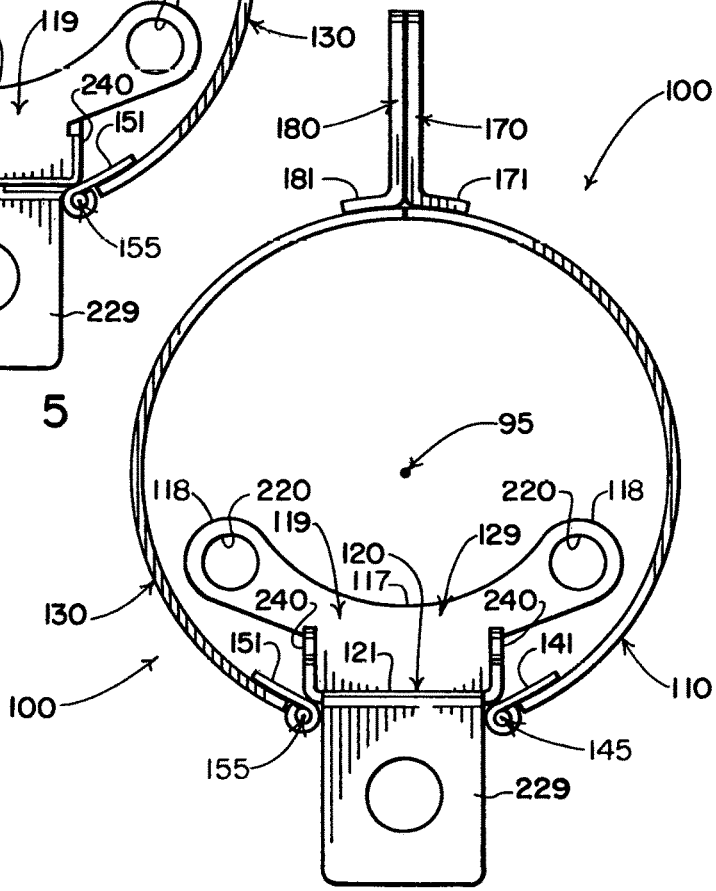
FIG. 6 is a bottom view thereof.
Figure 7:
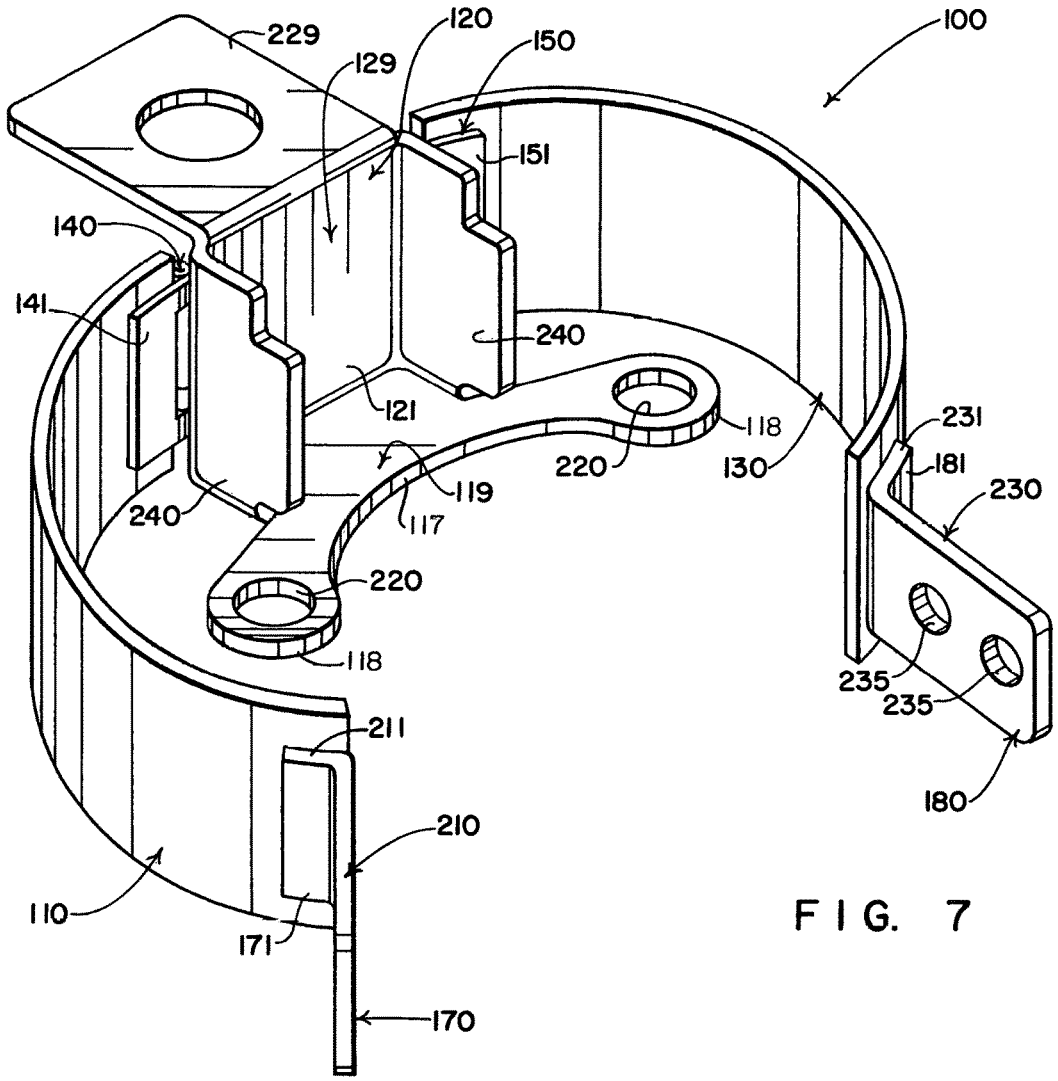
FIG. 7 is an inverted perspective view of the double-hinged embodiment of FIG. 1, with at least one of the hinge-connected components of the collar pivoted to an open position.
Figure 8:
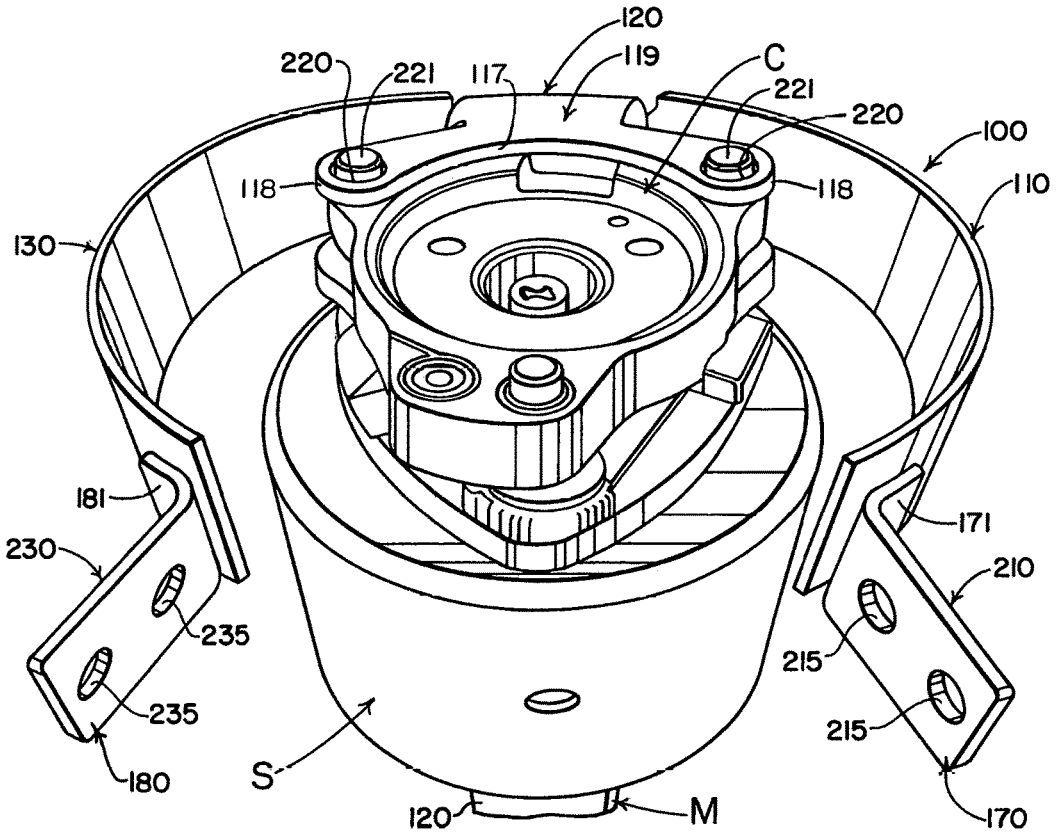
FIG. 8 is a perspective view showing the double-hinged security collar of FIGS. 1-7 in an open position being installed to surround and to partially overlie an assembly that needs to be shrouded and prevented from being accessed.
Figure 9:
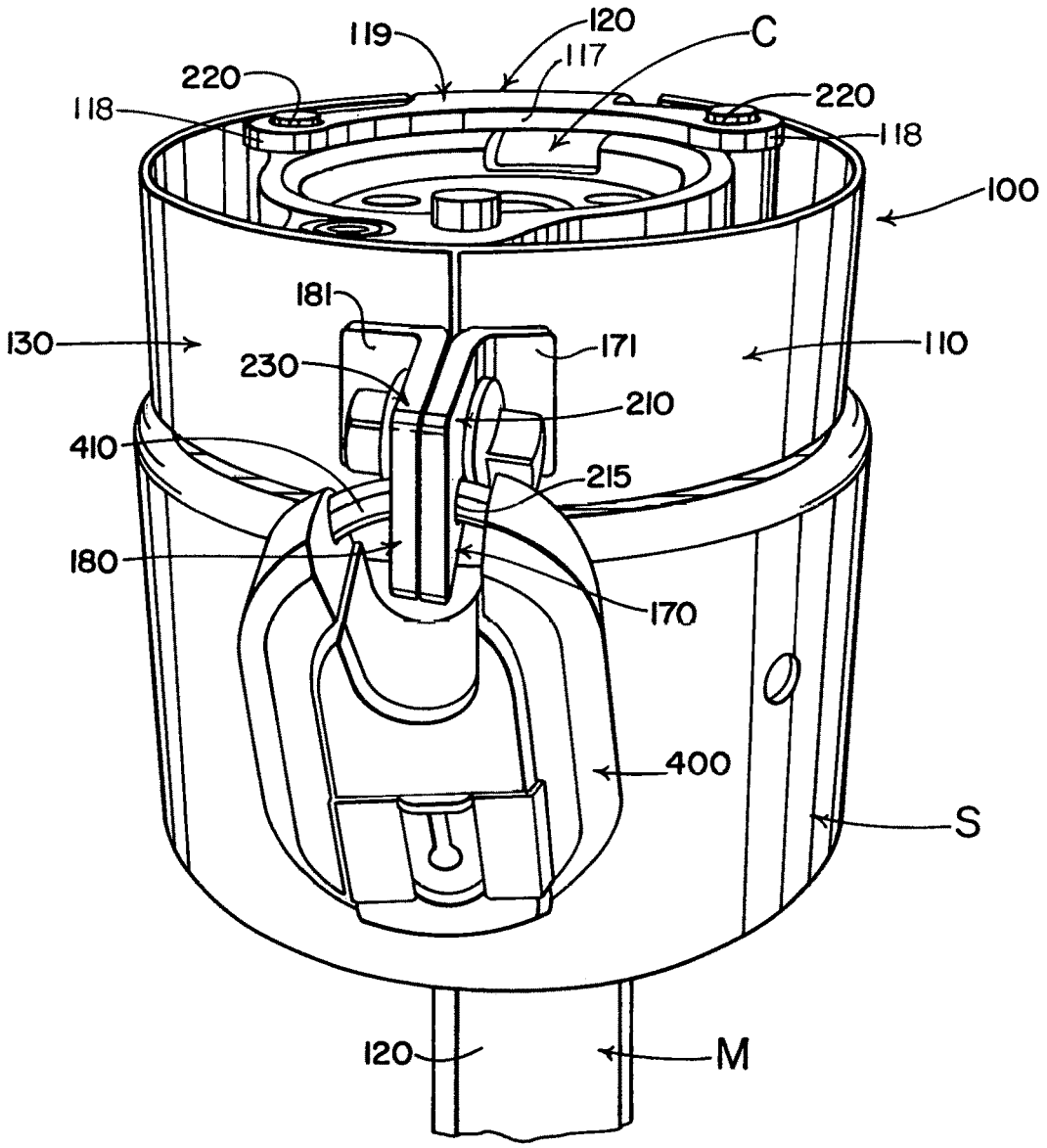
FIG. 9 is another perspective view showing the installed double-hinged security collar positioned as is shown in FIG. 8, but with opposed elongate components of the security collar closed and padlocked in closed position.

Features of one example of a double-hinged security collar 100 that embodies the present invention are shown in FIGS. 1-9, with FIGS. 8 and 9 showing how the security collar 100 can be installed to perimetrically surround, shroud and protectively enclose a portion of the Tri-Bracket connection assembly mentioned previously, that is indicated by the letter "C" in FIGS. 8 and 9.

Figure 21:
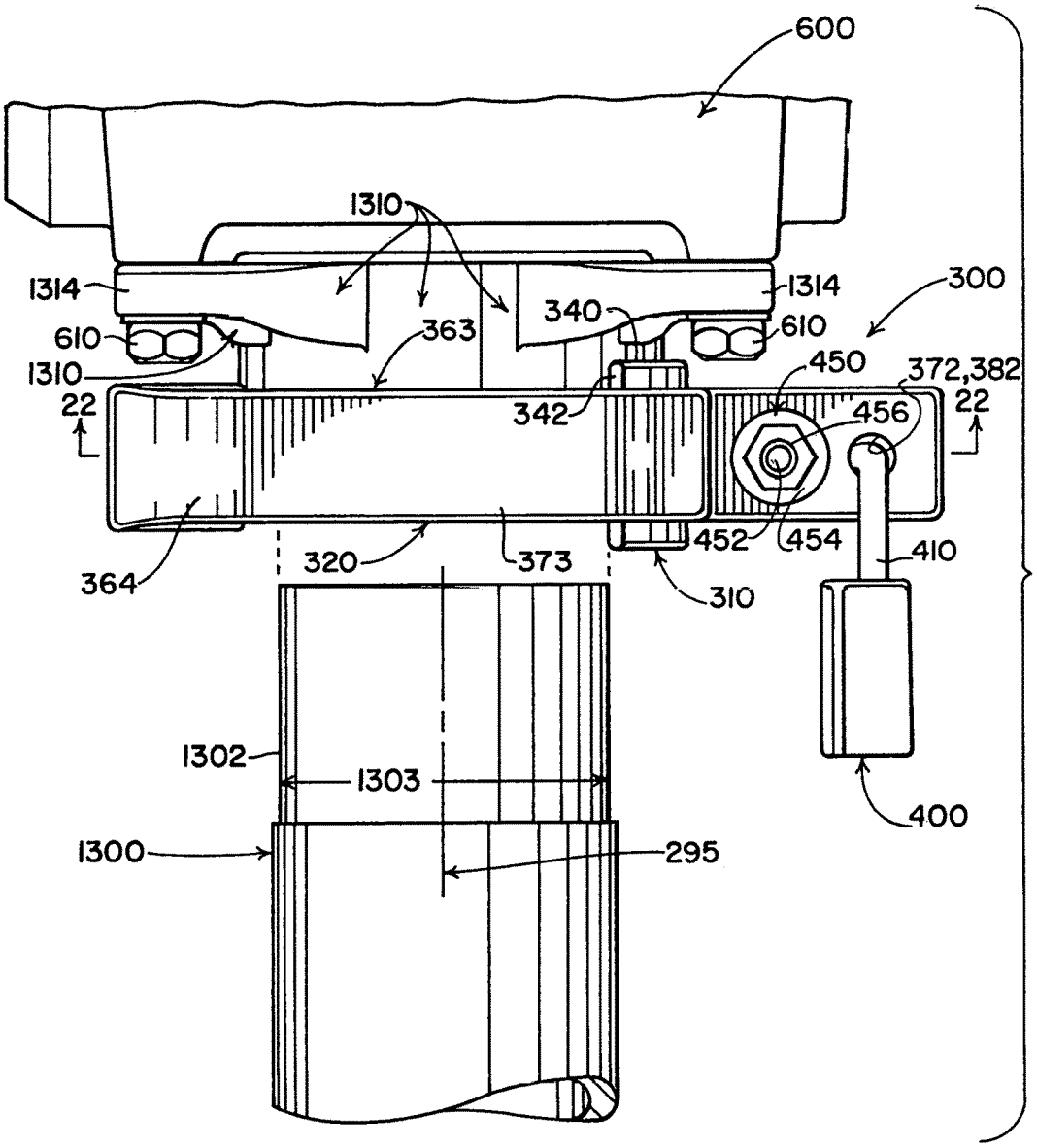
FIG. 21 is a rear elevational view of the security collar that corresponds to the rear elevational view of FIG. 16 except that the security collar is provided with a padlock and a threaded fastener assembly that hold the two components of the security collar in a closed position, and except that other components surrounded by the security collar are shown in disassembly, with a portion of a costly GPS signal receiving and transmitting unit being fixed atop a housing that defines one of the depicted tubular components.
Figure 22:
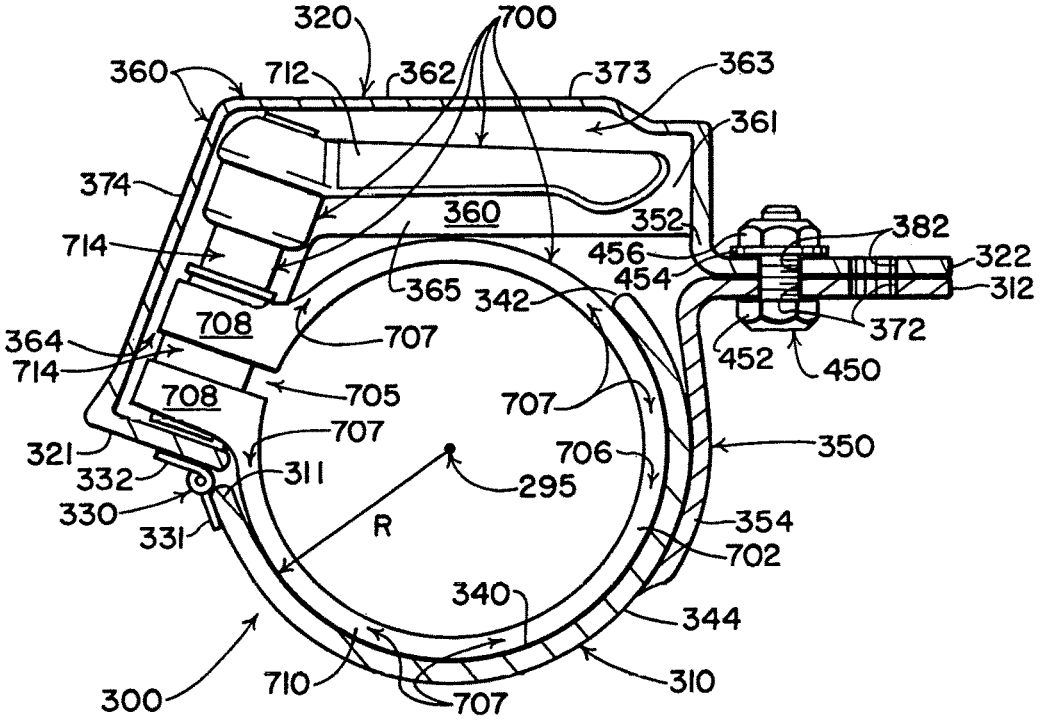
FIG. 22 is a cross-sectional view looking upwardly as seen from a plane indicated by a line 22-22 in FIG. 21 showing the two hingedly connected components of the security collar protectively enclosing, surrounding, shrouding and limiting access to relatively movable parts of a clamping device that is provided to adjustably couple the clamping device to a tubular upstanding mast member that is shown in FIG. 21, except with a padlock removed.
Figure 26:
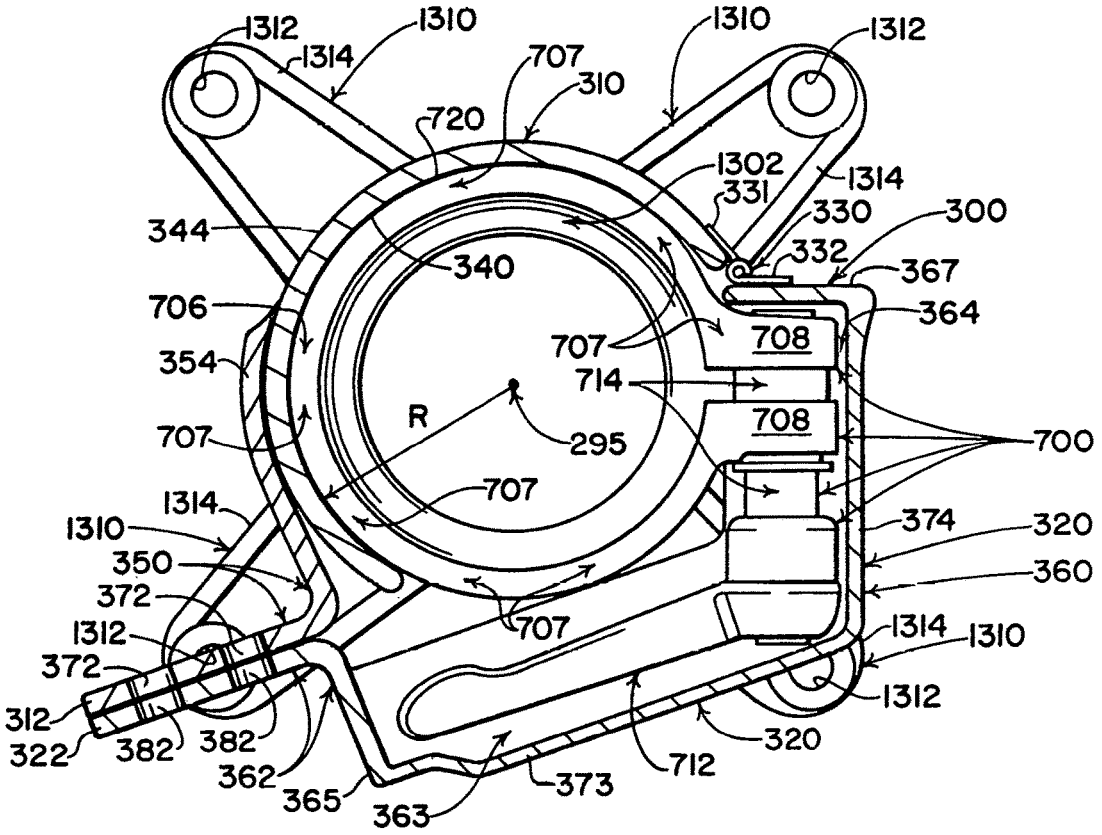

Features of another example of a security collar 300 that embodies the present invention are shown in FIGS. 10-26, with FIGS. 22 and 26 serving to best show how the security collar 300 perimetrically surrounds, shrouds and protectively encloses a connection assembly indicated by the numeral 700.

Figure 1:
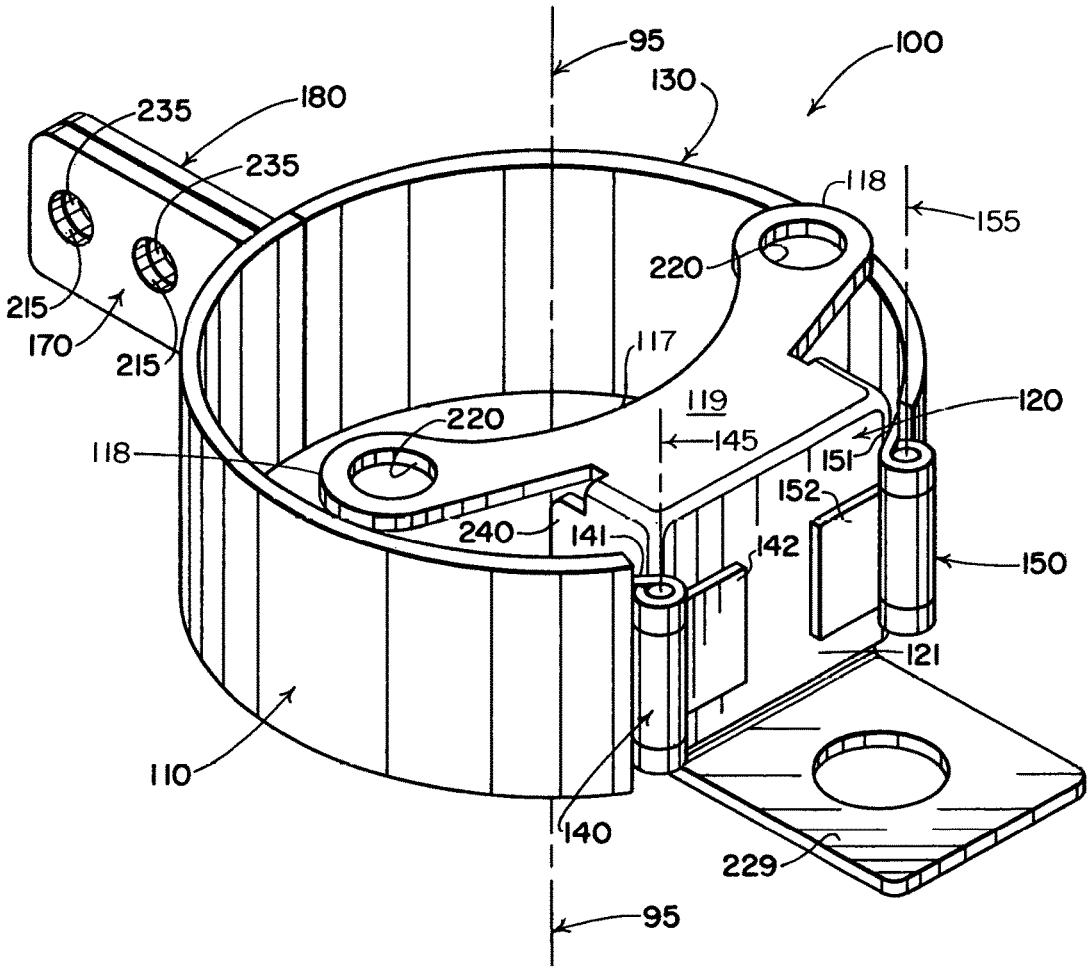
FIG. 1 is a perspective view showing a double-hinged embodiment of a padlockable security collar that incorporates features of the present invention, with the hinge-connected components of the security collar pivoted to a closed position that causes opposite end formations of the security collar to extend in overlying relationship, with holes defined by the end formations aligned.

Referring to FIGS. 1 and 7, the double-hinged security collar 100 includes first, second and third elongate components 110, 120, 130, respectively, as well as first and second hinges 140, 150, respectively.

The first component 110 and the second component 120 are located adjacent each other, and are pivotally connected by the first hinge 140. The second component 120 and the third component 130 are located adjacent each other, and are pivotally connected by the second hinge 150.

The second component 120 takes substantially the same form as a so-called "cover 180" that is shown in FIGS. 6 and 8 of the aforementioned utility application Ser. No. 14/544,686, the disclosure of which is incorporated herein by reference. The second component 120 defines an inwardly-facing compartment 129 (FIGS. 6 and 7) that protectively encloses relatively movable members (not shown in the drawings hereof, but disclosed in detail in the utility application referenced just above).

When the components 110, 120, 130 of the security collar 100 are in a closed position shown in FIG. 1, the arcuate first and third components 110, 130 can be said to face radially inwardly toward an imaginary central axis 95 that is shown in several of the drawing views. When the security collar 100 is installed on a columnar structure (not shown), the columnar structure will extend along the imaginary central axis 95.

Looked at in a slightly different way, the first and third components 110, 130 can be seen to "bulge away from" the interior region that is perimetrically surrounded by the components 110, 120, 130 of the security collar 100.

Figure 2:
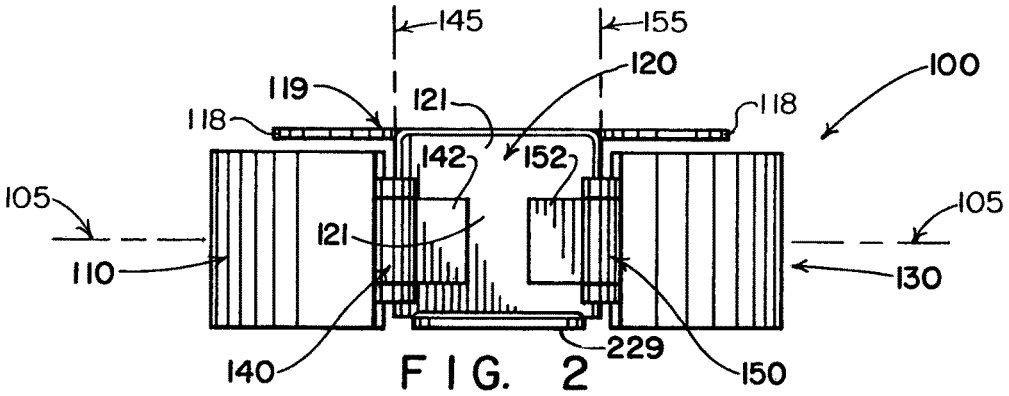
FIG. 2 is a front view thereof.
Figure 3:
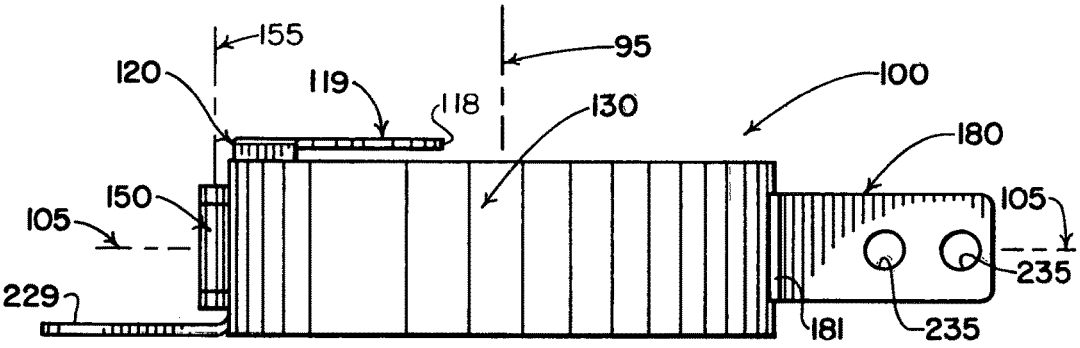
FIG. 3 is a right side view thereof, it being understood that a left side view is identical hereto but a mirror image reversal hereof.

The components 110, 120, 130 all extend in a common plane that is indicated generally by a line 105 in FIG. 3; and, the axes of hinges 140, 150 all extend perpendicular to the plane 105—which is true regardless of whether the security collar 100 is in an open position such as is shown by FIGS. 7 and 8, or in the closed position shown in FIGS. 1-6 and 9.

Opposite end regions of the first and third components 110, 130 carry end formations 170, 180, respectively. The end formations 170, 180 extend in overlying side-by-side engagement when the first and third components 110, 130 are in the closed position shown in FIGS. 1-6 and 9.

When the first and third components 110, 130 are pivoted to an open position such as is shown in FIGS. 7 and 8, the first and third components 110, 130 are both ordinarily pivot about pivot axes that are defined by the first and second hinges 140, 150, respectively—which is to say that the first and third components 110, 130 both ordinarily pivot relative to the second component 120, in the manner shown in FIGS. 7 and 8.

When the first, second and third components 110, 120, 130 are in the open position shown in FIG. 7, the resulting openness of the security collar 100 permits the security collar 100 to be wrapped around the Tri-Bracket connection assembly indicated by the letter "C" in FIGS. 8 and 9—with FIG. 9 showing how the security collar 100 can close around the Tri-Bracket connection assembly "C," and can then be secured by a padlock 400 that has its shackle inserted through holes 215, 235 that can best be seen in FIGS. 1 and 8.

When the Tri-Bracket connection assembly "C" is perimetrically surrounded by the security collar 100 as is shown in FIG. 9, portions of the second component 120 define the inwardly-facing compartment that is indicated by the numeral 129 in FIGS. 6 and 7. The compartment 129 is overlaid and partly defined by the inwardly extending member 119 that defines two holes 220 that can receive upstanding formations 221 of the Tri-Bracket assembly "C," as is shown in FIG. 8.

Figure 4:
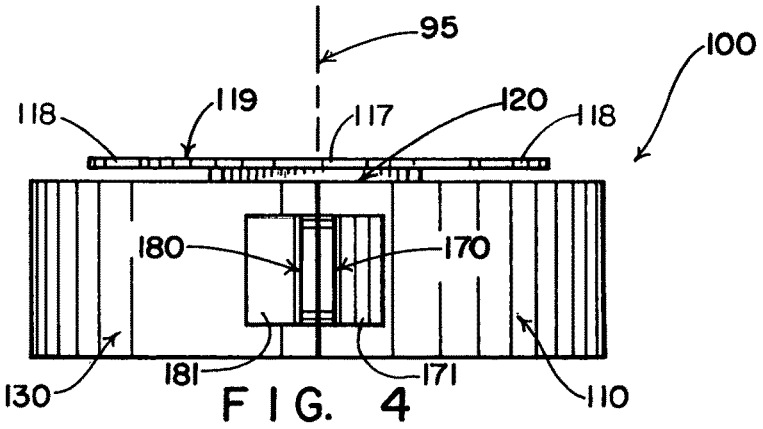
FIG. 4 is a rear elevational view thereof.

As can best be seen in FIGS. 4 and 7, the end formations 170, 180 have short legs 171, 181 that extend alongside end regions of the first and third components 110, 130, respectively, and are welded or otherwise bonded thereto.

The hinges 140, 150 permit the first and third components 110, 130 to pivot relative to the second component 120 between the closed position shown in FIG. 1, and various open positions such as the open position shown in FIGS. 7 and 8. When the security collar 100 has its components 110, 120, 130 in a closed position such as is shown in FIGS. 1-6 and 9, the security collar 100 can be padlocked in place by extending a shackle of the padlock 400 through one of the pairs of aligned holes 215, 235 as shown in FIG. 9. Also, or alternatively, threaded fasteners can be extended through one or more of the pairs of aligned holes 215, 235 as also is shown in FIG. 9.

Referring to FIG. 1, the first hinge 140 has pivotally connected legs 141, 142 that are connected by being welded or otherwise bonded to the first and second components 110, 120, respectively. Likewise, the second hinge 150 has pivotally connected legs 151, 152 that are connected by being welded or otherwise bonded to the third and second components 130, 120, respectively.

The first and third components 110, 130 are of arcuate configuration, and are substantially identically configured. The second component (which extends between and connects the first and third components 110, 130) has a substantially flat central portion 121 at the rear of the inwardly-facing compartment 129 shown in FIGS. 6 and 7.

As can be seen in FIGS. 1 and 2, the hinges 140, 150 define pivot axes 145, 155 that extend perpendicularly to the center plane 105 shown in FIGS. 1 and 2. The hinge axes 145, 155 are also identified in various other views of the drawings.

Figure 5:
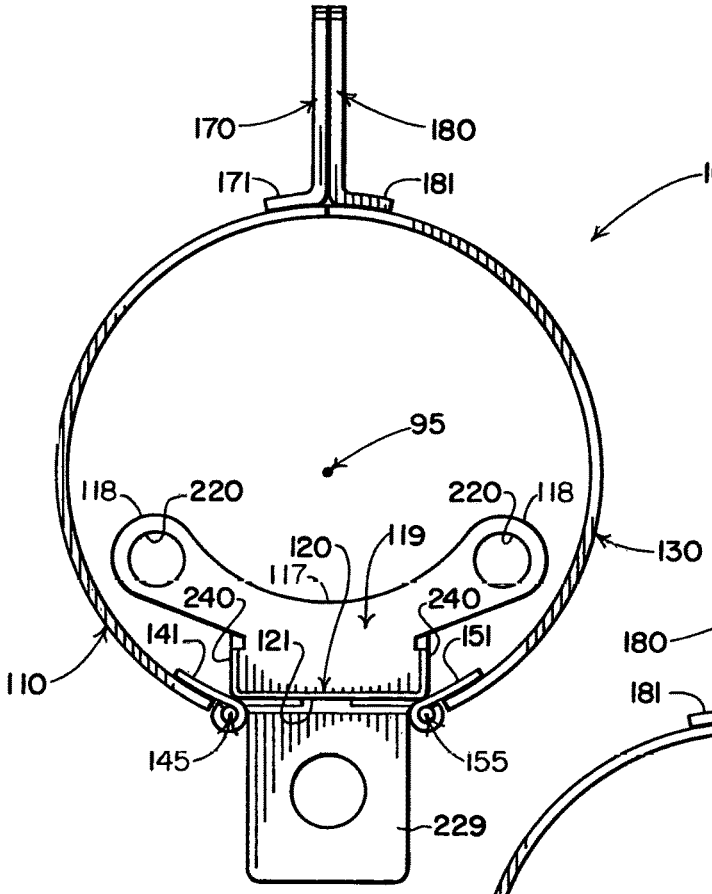
FIG. 5 is a top view thereof.

As can best be seen in FIGS. 1 and 5-6, the feature 119 defines two oppositely extending wing formations 118 that are connected by an arcuate surface 117 that wraps partway around the center axis 95 at a location that is spaced from the center axis 95.

As can be seen in FIGS. 6 and 7, the second component 120 (of the three hinge-connected components 110, 120, 130) has a substantially flat, generally rectangular portion 121 that bridges between the arcuate end components 110, 130. As can also be seen in FIGS. 6 and 7, the two wall formations 240 and the overlying wall formation 119 are formed integrally with the flat portion 121 of the second component 120; and, the features 119, 121, 240 cooperate to define a portion of a compartment 129 that faces toward the center axis 95.

As can be seen in FIG. 9, a center region "C" (that can be occupied by an assembly also designated by the letter "C") is endlessly perimetrically surrounded by the components 110, 120, 130 when the security collar 100 is in the closed position shown in FIGS. 1-8.

As can be seen in FIGS. 7 and 8, when the padlockable security collar 100 is in the open position, the security collar 100 no longer perimetrically surrounds the center region "C" shown in FIG. 9.

In the paragraphs that follow, the term "radially inwardly" means facing inwardly toward the imaginary central axis 95, and the term "radially outwardly" means facing outwardly away from the imaginary central axis 95.

Optional features of the security collar 100 are best shown in FIG. 7, that include:

1) One of the optional features is to provide one or more radially inwardly extending formations—such as the previously described member 119 that defines the two holes 220 that are shown in FIG. 8 receiving two upwardly extending formations 221 of the Tri-Bracket connection assembly "C."

2) One or more radially outwardly extending formations that can be connected to, or formed as an integral part of, one or more of the hinge-connected components 110, 120, 130—namely such formations as are indicated in many of the accompanying drawing views by the numeral 229 that can connect with one or more supports (not shown) located externally of a columnar structure onto which the security collar 100 is installed. Such support connected formation(s) 229 can provide additional support for a columnar structure onto which the security collar 100 is installed.

3) One or more additional formations that can be connected to, or formed as an integral part of, one or more of the hinge-connected components 110, 120, 130—namely such formations as are indicated in FIG. 7 by the numeral 240 that can form opposite sides of the compartment 129 described previously.

Continuing in the spirit of the invention disclosed herein, more complexly configured security collar embodiments (not shown in the drawings hereof) can include three or more hinges that connect four or more components—with all of such embodiments conforming to the guideline that the total number of hinges (or pivotal connections) is one less, in number, than the total number of components that are connected by the hinges (or pivotal connections).

Figure 10:
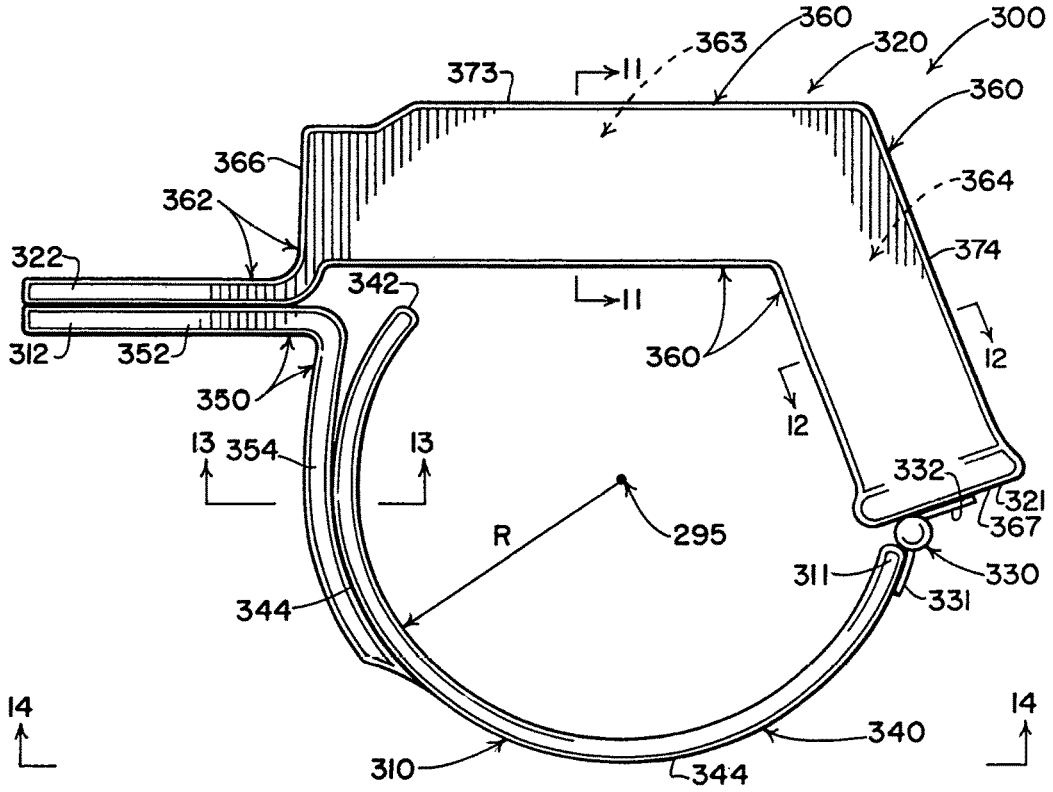
FIG. 10 is a top view of a single-hinged embodiment of a security collar that incorporates features of the present invention, with the view showing the two elongate hinge-connected components of the security collar pivoted to a closed position, it being understood that a bottom view thereof is identical thereto but a mirror image reversal thereof.
Figure 15:
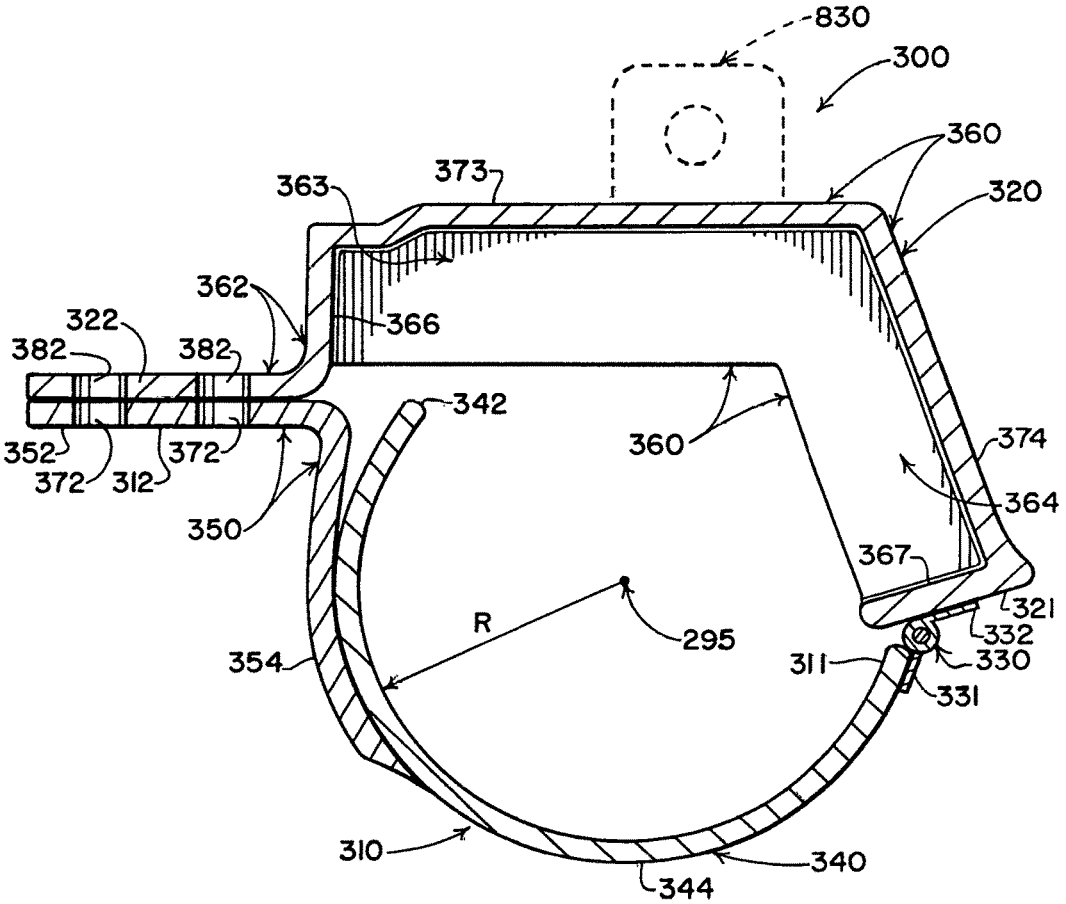
FIG. 15 is a cross-sectional view looking downwardly, as seen from a plane indicated by a line 15-15 in FIG. 14, it being understood that a view looking upwardly from the same plane is identical thereto but a mirror image thereof.
Figure 16:
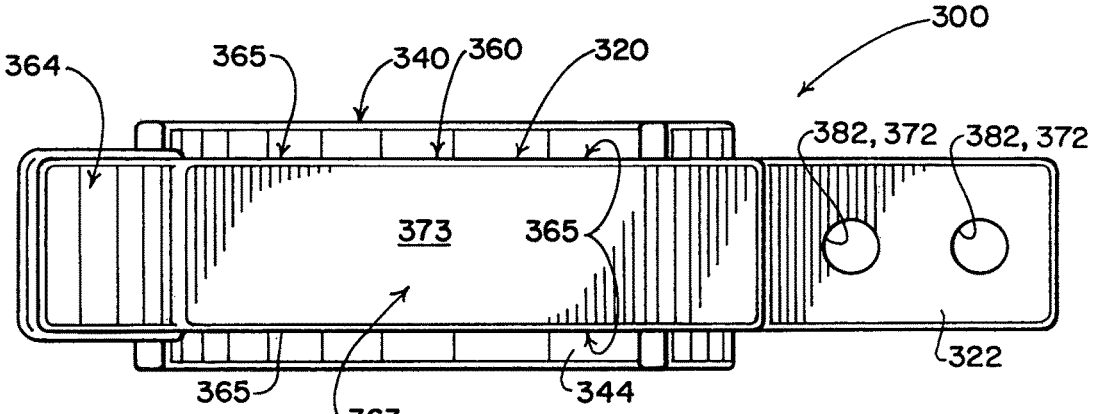
FIG. 16 is a rear elevational view thereof.
Figure 20:
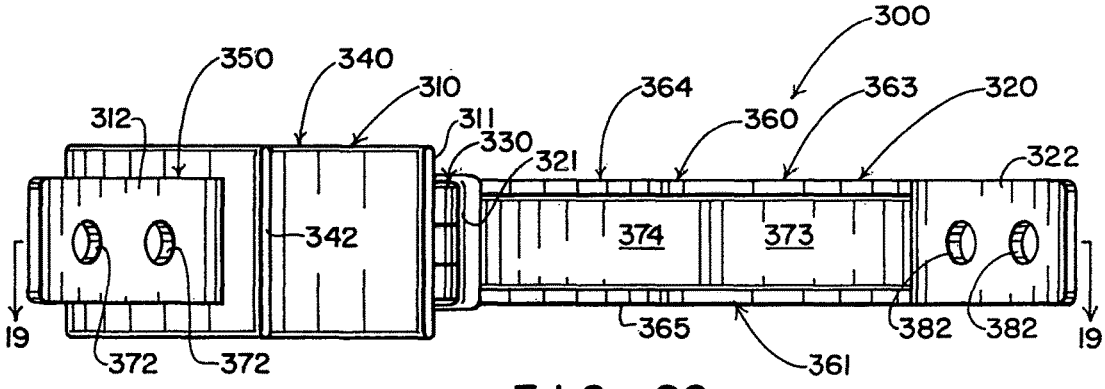
FIG. 20 is a front elevational view with the hinged components of the security collar pivoted to an open position.

Referring to FIGS. 10, 15 and 20, the single-hinged security collar 300 includes two elongate components 310 and 320 that are pivotally connected by a single hinge 330. The components 310, 320 extend in a common plane indicated by a line 305 in FIG. 17; and, the axis of the hinge 330 extends perpendicular to the plane 305.

Figure 19:
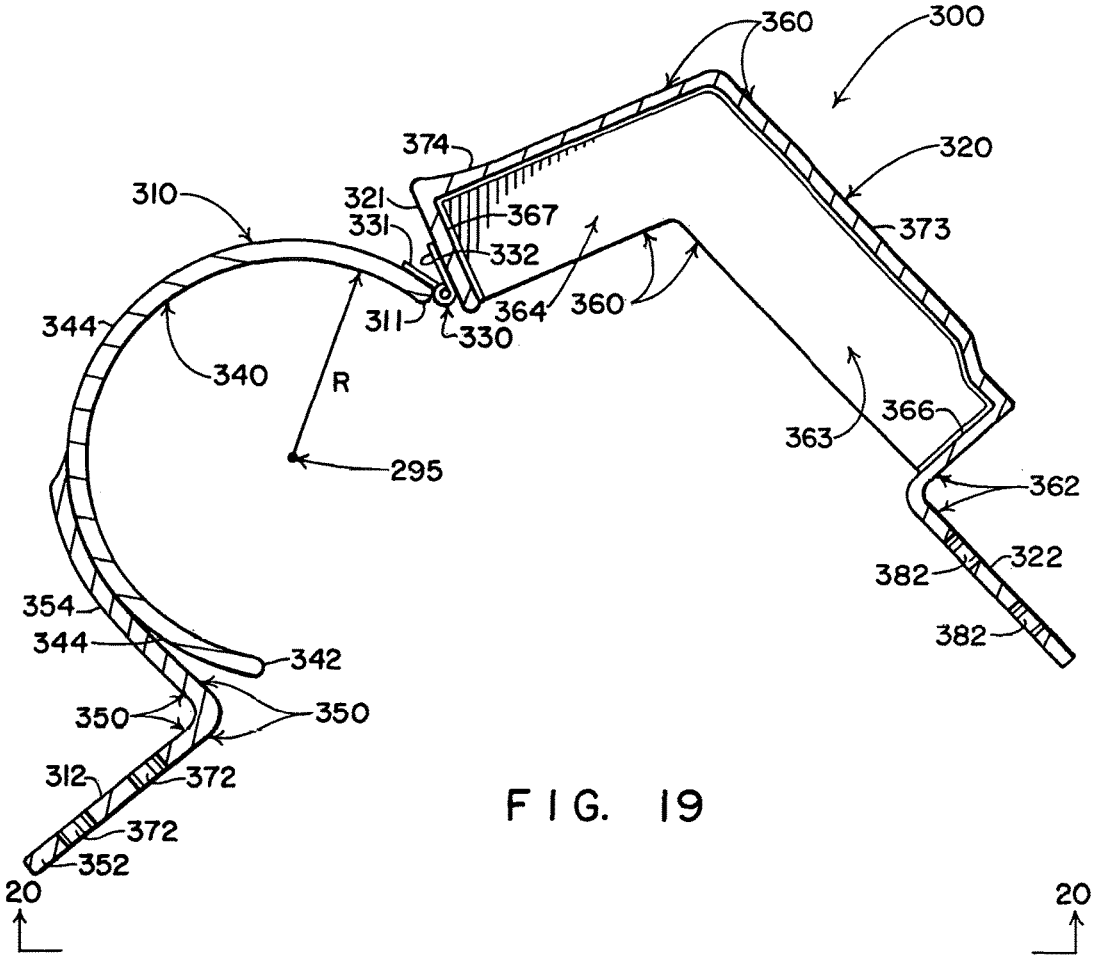
FIG. 19 is a cross-sectional view looking downwardly as seen from a plane indicated by a line 19-19 in FIG. 20, with the view also including a line 20-20 which indicates a plane from which a front elevational view of FIG. 20 is seen.

A closed position of the hinge-connected components 310, 320 is best shown in FIGS. 10 and 15. One of many possible open positions of the hinge-connected components 310, 320 is shown in FIGS. 19 and 20.

As can be seen in FIGS. 10 and 15, the elongate first component 310 has an arcuately curved portion that is a segment of a circle which extends about the central axis 295 when the components 310, 320 of the security collar 300 are in the closed position. As can best be seen in FIG. 15, the elongate second component 320 has an L-shaped portion 360 that defines connecting interior portions 363, 364. Outer walls 373, 374 surround the interior portions 363, 364.

As can be seen in FIGS. 22 and 26, when the security collar 300 can wrap perimetrically around a connection assembly 700 that has relatively movable members 712 and 714 that can be ratcheted to tighten or loosen the grip of a C-shaped clamping member 706, 707 that has opposite end regions 708 that move toward or away from each other, depending on whether the ratchet components 712, 714 tighten or loosen the grip of the clamping component portions 708 on an upstanding cylindrical member indicated in FIGS. 21 and 26 by the numeral 1302 of an upstanding structure 1300.

As can be seen in FIGS. 10, 15, 22 and 26, opposite end regions of the first and second components 310, 320 carry end formations 312, 322, respectively. The end formations 312, 322 extend in overlying side-by-side engagement when the first and second components 310, 320 are in the closed position that is best shown in FIGS. 10, 15, 22 and 26.

When the first and second components 310, 320 pivot to an open position such as is shown in FIGS. 19 and 20, the first and second components 310, 320 pivot about the pivot axis that is defined by the hinge 330.

When the first and second components 310, 320 open as is shown in FIGS. 19 and 20, this openness of the security collar 300 permits the security collar 300 to be wrapped around the aforementioned columnar structure 1300 to encircle a slightly reduced diameter upper end region 1302 of the upstanding support structure 1300 that is shown in FIG. 21.

The interior, inwardly-facing compartment portions 363, 364 are nicely suited to closely receive, shroud, protectively enclose, and limit access to the relatively movable components of the connection assembly 700.

The hinge 330 permits the first and second components 310, 320 to pivot relative to each other between the closed position (shown in FIGS. 10 and 14-18) and various open positions (such as is shown in FIGS. 19 and 20).

When the security collar 300 has its chain of hinge-connected components 310, 320 in the open position (such as is shown in FIGS. 19 and 20), the components 310, 320 of the security collar 300 can be removed from, or can be wrapped perimetrically around (and thereby installed onto) a selected region or zone of a columnar structure (in the manner that is best shown in FIGS. 22 and 26). When the security collar 300 has its components 310, 320 in a closed position (such as is best shown in FIGS. 10, 15, 22 and 26) the security collar 300 can be padlocked in place on the slightly reduced diameter portion 1302 of the columnar structure 1300 (in the manner shown in FIG. 21) by extending one or more shackles 410 of one or more padlocks 400 through the pairs of aligned holes 372, 382 (best shown in FIGS. 14-16 and 21) that are provided through the end formations 312, 322 (best shown in FIGS. 15, 22, 25 and 26).

Threaded fasteners (one being indicated by the numeral 452 in FIG. 21) secured by nuts (one being indicated by the numeral 454 in FIG. 21) can also be extended through one or more of the pairs of aligned holes 372, 382 to assist in holding the components 310, 320 in closed position—and, more pairs of the aligned holes 372, 382 can be provided, if desired.

The hinge 330 has pivotally connected legs 331, 332 that are connected by being welded or otherwise bonded to the first and second components 310, 320, respectively.

Figure 11:
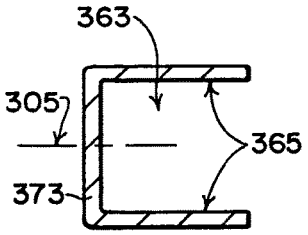
FIG. 11 is a cross-sectional view as seen from a plane indicated by a line 11-11 in FIG. 10.
Figure 12:
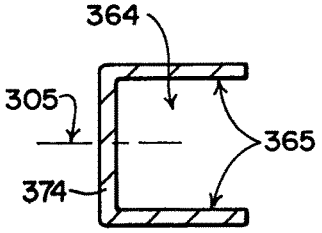
FIG. 12 is a cross-sectional view as seen from a plane indicated by a line 12-12 in FIG. 10.
Figure 13:
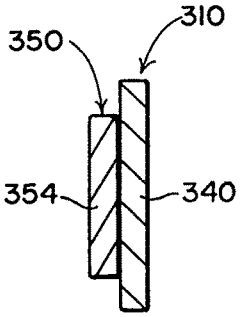
FIG. 13 is a cross-sectional view as seen from a plane indicated by a line 13-13 in FIG. 10.
Figure 14:
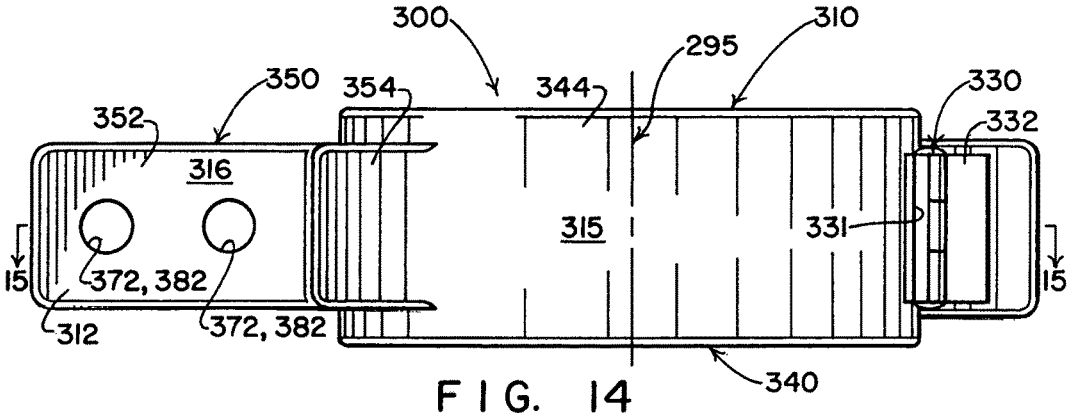
FIG. 14 is a front elevational view thereof as seen from a plane indicated by a line 14-14 in FIG. 10.

As is best shown in FIGS. 10, 15, 19, 22 and 26, the first component 310 is of arcuate, generally semicircular configuration that extends for approximately one-hundred-eighty degrees from a first end region 311 to a second end region 342; and, the second component 320 can be seen to be dominated by the generally L-shaped structure 360 that has the relatively longer leg 373, and the relatively shorter leg 374. Both of the legs 373, 374 have generally U-shaped cross-sections that define portions 363, 364 by the numerals 363, 364, respectively, and are shown in FIGS. 11 and 12, respectively.

Figure 23:
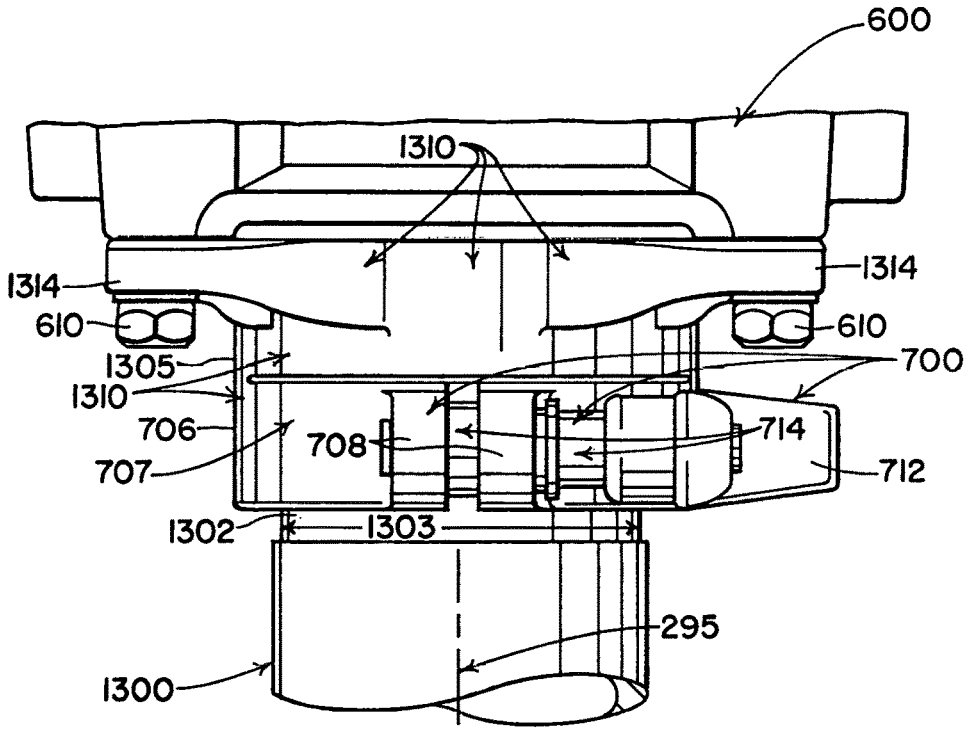
FIG. 23 is a side view of the assembled components shown in FIG. 21 that have been inverted and turned about an axis of the upstanding tubular member shown in FIG. 21, but with the security collar removed from the clamping device.
Figure 24:
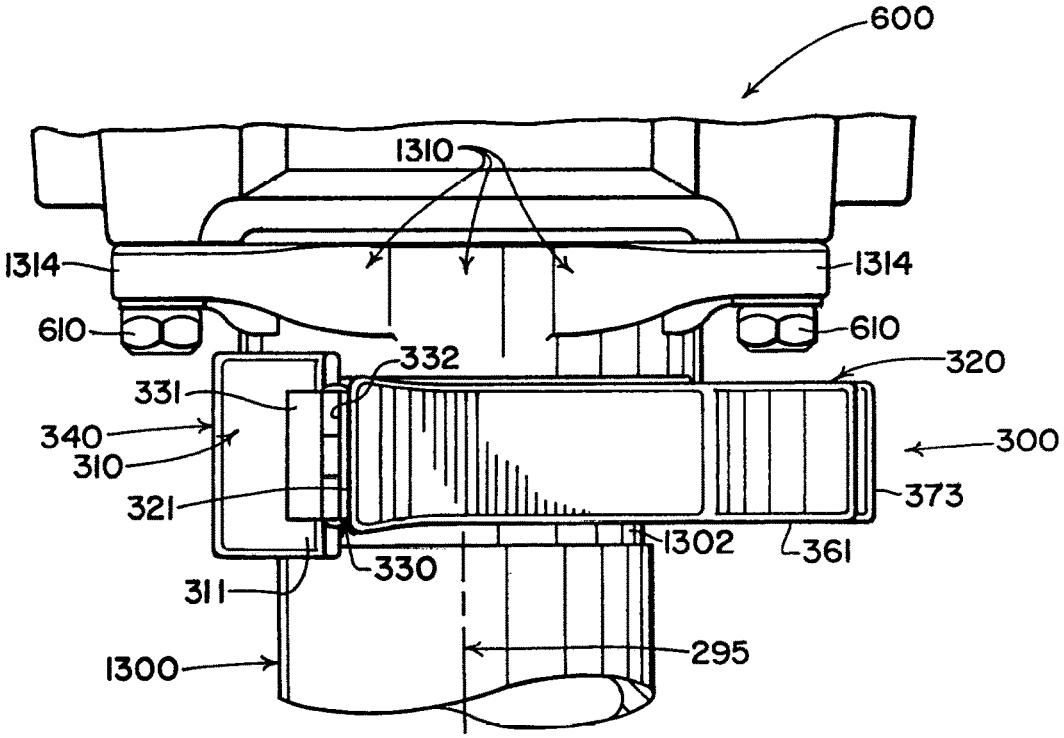
FIG. 24 is a side view substantially identical to FIG. 23 but with the security collar installed to protectively enclose, surround, shroud and limit access to the clamping device.
Figure 25:
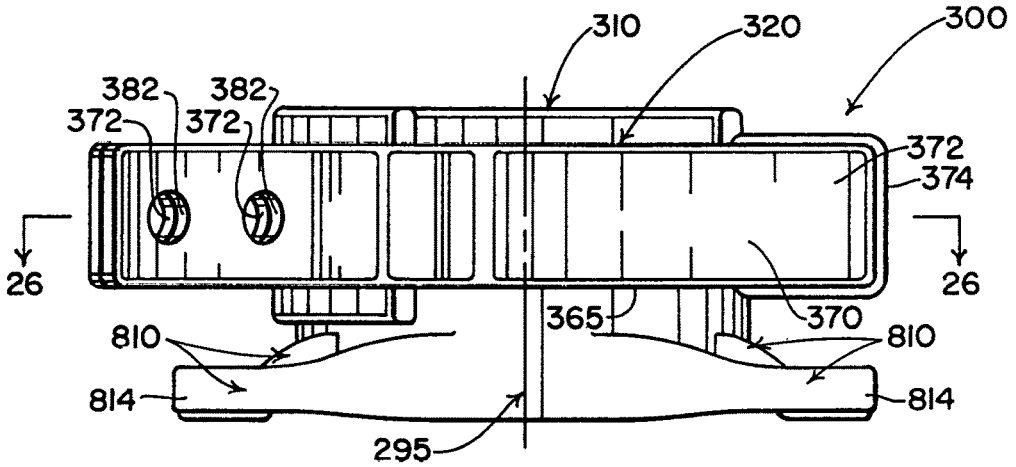
FIG. 25 is a side view showing an assembly of selected ones of the components shown in FIGS. 21-24, except that the depicted components have been inverted and turned about a vertical axis shown in FIGS. 21-24; and, FIG. 26 is a cross-sectional view as seen from a plane indicated by a line 26-26 in FIG. 25.

Referring to FIGS. 21, 23 and 24 hereof, the numeral 1300 designates a typical component of an upstanding mast—which can represent an uppermost component of such masts as are shown in FIG. 1 of the Taylor et al U.S. Pat. No. 8,478,492 that is incorporated herein by reference. Also shown in FIGS. 21, 23 and 24 hereof is a bottom portion 600 of a GPS unit which can represent one of the two costly prior art GPS signal units shown in FIG. 1 of the above-identified Taylor et al patent that is carried atop masts that extend upwardly from opposite end regions of a blade mounted on a bulldozer shown in FIG. 1 of the Taylor et al patent.

In FIG. 21 hereof, the mast component 1300 is shown having an upper end region 1302 which has a reduced diameter 1303 that is concentric about the upwardly extending central axis 295 of the mast component 1300. The reduced diameter upper end region 1302 of the mast component 1300 can extend snugly upwardly into a lower end region of a bracket 1310, as is best shown in FIGS. 23 and 24. The adjustable coupler assembly 700 shown in FIGS. 22 and 23) can be operated to selectively permit and prevent the bracket 1310 to be turned about the central axis 295 that extends centrally through the upwardly extending mast component 1300.

In the environmental example that is the subject of FIGS. 21-26, the adjustable coupler assembly 700 is used just as adjustable coupler assemblies are commonly used in other prior art applications, to selectively permit and prevent relative movement of two relatively movable components—in this case, the upstanding mast component 1300, and the bracket 1310.

As those who are skilled in the art will readily appreciate, the adjustable coupler assembly 700 can be formed as an assembly that is entirely separate and apart from both of the relatively movable members 1300, 1310. In an alternative, the adjustable coupler assembly 700 can be hung from or otherwise attached to a selected one of the relatively movable members 1300, 1310, and can serve to grip the other of the relatively movable members 1300, 1310 in a manner that selectively permits and prevents the members 1300, 1310 to move relatively to each other. In this example, the adjustable coupler assembly 700 happens to have one component that is rigidly connected to the bracket 1310 by being formed integrally therewith, as will be explained shortly.

Nothing about the adjustable coupler assembly 700 is new—rather, adjustable coupler assemblies (such as the one indicated generally by the numeral 700 in FIGS. 22, 23 and 26) are commonly used in many applications in industry where one relatively movable member (such as the bracket 1310) needs to be securely but adjustably connected to another relatively movable member (such as the upwardly extending mast component 1300).

Referring to FIGS. 22, 23 and 26, the adjustable coupler assembly 700 includes a beefy, nearly annular, U-shaped clamping component 707 that has a nearly circular rear region 706 (best shown in FIG. 23) that is fronted by a pair of spaced, forwardly-extending regions 708 that can be moved toward and away from each other to tighten or loosen the grip of the nearly circular rear region 706 on the reduced diameter portion 1302 of the upstanding mast 1300 (that is best shown in FIG. 21—it being understood that the reduced diameter portion 1302 extends upwardly through the circular clamping rear portion 706 of the U-shaped clamping component 707 when the components of FIG. 21 are assembled as shown in FIG. 23, whereafter the clamping component 707 is tightened about the reduced diameter portion 1302, and the security collar 300 is then installed and padlocked in place (as is shown in FIG. 21 to prohibit unauthorized access to the clamping component 707).

Referring to FIGS. 22, 23 and 26, the U-shaped clamping component 707 includes the pair of spaced formations 708 that can be moved selectively relatively toward or relatively away from each other by a threaded fastener assembly 714 that can be operated by a ratchet handle 712.

When the ratchet handle 712 is turned back and forth about an imaginary axis of the threaded fastener assembly 714 (in a conventional back and forth manner that a ratchet is typically operated) to cause the fastener assembly 714 to move the spaced formations 708 relatively away from each other, the grip of the clamping component 707 on the reduced diameter upper end region 1302 of the upstanding mast component 1300 is loosened.

When the ratchet handle 712 is turned back and forth (in the conventional manner that a ratchet is operated) to cause the fastener assembly 714 to move the spaced formations 708 relatively toward each other, the grip of the clamping component 707 on the reduced diameter upper end region 1302 of the upstanding mast component 1300 is tightened to prevent the bracket 1310 from turning about the axis 295 relative to the mast component 1310—and, to prevent the bracket 1310 from being loosened and removed from the mast component 1300.

Because the clamping member 707 of the adjustable coupler assembly 700 is used to selectively permit and prevent relative movement between the two relatively movable members 1300, 1310 from taking place, the adjustable coupler assembly 700 can be seen to be a clamping type of adjustable coupler assembly 700—hence, the adjustable coupler assembly 700 is occasionally referred to herein as the clamping assembly 700.

As is shown in FIGS. 21, 23 and 24, cap screws 610 are used to securely attach the GPS unit 600 to the bracket 1310. The bracket 1310 has four arms 1314 that extend radially outwardly with respect to a central axis 295 (shown in FIGS. 21-26). Holes 1312 (shown only in FIG. 26) are provided through the arms 1314 of the bracket 1310 so the cap screws 610 can extend through the holes 1312, and can be tightened in place to securely couple the GPS unit 600 to the bracket 1310.

Once the bracket 1310 (with the GPS unit 600 attached thereto) has been installed on the reduced diameter upper end region 1302 of the mast component 1300, the GPS unit 600 and the bracket 1310 can be turned (if this is needed to permit the GPS unit to properly communicate with other signalling units that may be located miles away from the GPS unit 600), whereafter the adjustable connector or clamping assembly 700 is tightened to rigidly secure the GPS unit 600 and the bracket 1310 to the mast component 1300. The mast component 1310 can then be raised as may be needed to permit the GPS unit 600 to properly communicate with GPS signalling satellites situated above the Earth.

A problem with the adjustable connector assembly 700 is that it has presented an attractive target to those who would steal the costly GPS unit 600 and sell it to others who will gladly put it to use on other construction equipment. The thieves covertly enter a construction site when a bulldozer or other equipment on which the GPS unit 600 is mounted is temporarily down for refueling or repair or maintenance. Thieves operate the ratchet handle 712 to loosen and remove the bracket 1310 from the mast component 1300 so the GPS unit 600 and attached bracket 1310 can be spirited away, often nearly under the noses of operators who may be taking a break for lunch.

When the ratchet handle 712 is turned to the position shown in FIGS. 22, 23 and 26, the ratchet handle 712 is in a so-called storage orientation where it is releasably retained by the operation of the threaded fastener assembly 714, so the ratchet handle 712 will not vibrate or rattle during operation of a bulldozer or other construction equipment on which the GPS unit 600 is carried. When in the storage position, the ratchet handle 712, the threaded fastener assembly 714, the spaced formations 708, and all other regions of the clamping component 707 can be perimetrically surrounded and protectively enclosed by the security collar 300, in a manner depicted in FIGS. 21, 22 and 24-26—and, a padlock 400 can be installed on the security collar 300 in the manner shown in FIG. 21 to prevent removal of the security collar 300.

The installed presence of the padlocked security collar 300 shrouds, limits access to, and prevents loosening of the adjustable coupler or clamping assembly 700—and thereby prevents theft of the costly GPS unit 600 because the bracket 1310 is prevented from being removed from the upstanding mast component 1300. The padlocked security collar 300 prevents operation of, and loosening of the adjustable coupler or clamping assembly 700 which, in turn, prevents removal of the bracket 1310 and attached GPS unit 600 from the mast component 1300.

As has been explained, to prevent theft of a costly device such as the costly GPS unit 600, the present invention provides the security collar 300 to protectively enclose, surround, shroud and limit access to the adjustable coupler or clamping assembly 700 so the coupler or clamping assembly 700 cannot be loosened thereby permitting the costly GPS unit 600 to be stolen together with the bracket 1310 to which the GPS unit is quite securely connected by the bolts 610. By using the security collar 300 to prevent operation of the adjustable coupler 700, disassembly of the relatively movable components 1300, 1310 is prevented—yet, when the security collar 300 is removed, the adjustable coupler or clamping assembly 700 can be loosened to permit movement of the bracket 1310 and the mast component 1300.

As is best shown in FIGS. 10, 15 and 20, the security collar 300 principally includes two elongate components 310, 320 that have adjacent end regions 311, 321, respectively, that are pivotally connected by the hinge 330. Opposite halves 331, 332 of the hinge 330 are pivotally connected by a non-removable hinge pin (of the hinge 330) that defines an imaginary axis about which the elongate components 310, 320 can pivot between the closed position best shown in FIGS. 10 and 15, and an open position such as is shown in FIG. 20. When the security collar 300 is in the closed position shown in FIGS. 10 and 15, the adjacent end regions 312, 322 of the elongate components 310, 320, respectively, extend in side-by-side engagement in a direction leading generally away from the location of the hinge 330.

The elongate component 310 of the security collar 300 includes a generally C-shaped portion 340 that has a substantially uniform radius "R" about the central axis 295 that is shown in FIGS. 10, 15 and 22 by a dot (inasmuch as the central axis 295 is shown end-on in these views of the drawings). One end region 311 of the C-shaped portion 340 is connected to the hinge component 331. An opposite end region of the C-shaped portion 340 is indicated by the numeral 342.

The uniform curvature of the C-shaped portion 340 extends substantially the full distance between the end regions 311 and 342 of the C-shaped portion 340. The uniform curvature of the C-shaped portion 340 defines substantially a one-hundred-eighty degree arc having a uniform radius "R" (shown in FIGS. 10, 15, 22 and 26) that substantially equals the radius of curvature of the exterior surface of the curved rear portion 706 of the clamping component 707. By this arrangement, when the security collar 300 is installed to protectively enclose the adjustable clamping assembly 700, the tall, C-shaped portion 340 of the elongate component 310 resides quite closely alongside much of the exterior surface of the rear portion of the clamping component 707, as is shown in FIGS. 22 and 26.

The elongate arcuate component 310 also includes a generally L-shaped member 350 formed by the relatively long and short legs 352 and 354. The short leg 352 includes the end region 312 through which are formed the holes 372 that are best seen in FIGS. 15 and 19. The slightly longer leg 354 curves slightly to match the exterior curved surface of the C-shaped portion 340 of the arcuate component 310, and is welded or otherwise bonded to the exterior surface of the C-shaped portion 340 of the arcuate component 310.

As can be seen in FIGS. 15 and 19, the elongate end region 322 of the component 320 includes a bend 362 that brings the end region 322 into parallel alignment with the end region 352 of the component 310 when the security collar 300 is closed, as shown in FIGS. 15 and 19. Referring to FIGS. 15 and 19, holes 382 are formed through the end region 322 to align with the holes 372 so that one or more shackles 410 (FIG. 21) of one or more padlock 400 (FIG. 21) can extend through the aligned holes 372, 382 to lock the security collar 300 in place when installed as shown in FIGS. 21-22 and 24-26.

Figure 17:
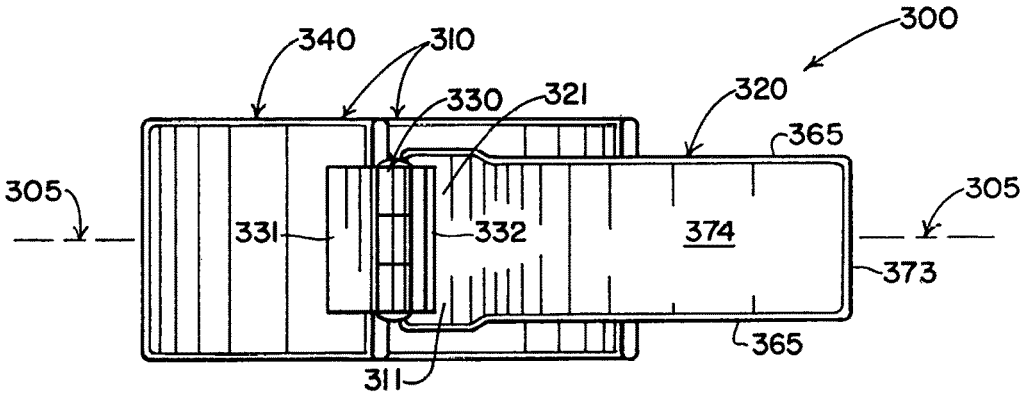
FIG. 17 is a right side elevational view thereof.
Figure 18:
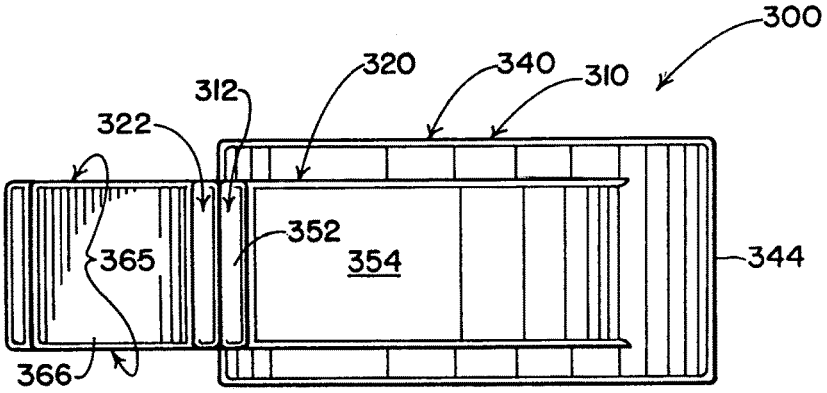
FIG. 18 is a left side elevational view thereof.

FIGS. 11, 12 and 17 show a common center plane 305 that cuts midheight through the entire security collar 100. The entire top half of the security collar 300 is symmetrical relative to the entire bottom half of the security collar 300.

Referring to FIGS. 11 and 12, top and bottom walls of the L-shaped compartment have internal portions 363, 364 that face inwardly toward the center axis 295 of the padlockable security collar 300.

Although the security collar 300 is not shown as being provided with a radially outwardly extending member such as the radially outwardly extending member 229 (shown in FIGS. 1, 3 and 5-7), such a radially outwardly extending member 830 (shown by broken lines in FIG. 15) can easily be added to the security collar 300 so the security collar 300 can serve to support such structure as is perimetrically surrounded by the security collar 300. In FIG. 15, the radially outwardly extending member 830 depicted by broken lines is depicted as being substantially identical to the radially outwardly extending member 229 shown in FIG. 1.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention.

What is claimed is:

1. A padlockable security collar consisting of three elongate components arranged end to end in a chain, including two relatively long, substantially identical, substantially arcuate end components of the chain, and one relatively short intermediate component of the chain that has a substantially flat, generally rectangular portion that bridges between and is pivotally connected to each of the two relatively long arcuate end components so the three elongate components of the security collar are permitted to move relative to each other by pivoting between open and closed positions of the security collar about pivot axes that extend substantially perpendicular to a common plane that extends through all three of the components, wherein:

the two substantially arcuate end components have padlockable end formations that engage and can be padlocked together when the security collar is in the closed position wherein the security collar can be seen to wrap perimetrically around a generally circular central area;

the configurations of the three elongate components of the security collar also permit the padlockable end formations to disengage and separate sufficiently from each other so the security collar can withdraw from perimetrically surrounding the central area when the security collar is in the open position; and the intermediate component of the security collar also has three generally flat portions that extend substantially perpendicular to the substantially flat, generally rectangular portion of the intermediate component, and that cooperate with the substantially flat, generally rectangular portion to at least partially form a compartment that faces toward a central axis of the central area when the security collar is in the closed position, including:

i) two substantially identical, spaced-apart wall formations that extend from the substantially flat, generally rectangular portion into the central area in planes that substantially parallel the central axis of the central area when the security collar is in the closed position; and ii) a third wall formation that extends from the substantially flat, generally rectangular portion toward the central axis so as to either overlie or to underlie a part of the central area when the security collar is in the closed position, with the third wall formation defining two oppositely extending wing formations that each reach toward but do not engage a different one of the two substantially arcuate end components of the security collar when the security collar is in the closed position.

2. The padlockable security collar of claim 1, wherein the two wing formations have configurations that are substantially identical.

3. The padlockable security collar of claim 2, wherein the third wall formation defines an arcuate surface that connects the two wing formations and wraps part of the way around the central axis at a distance spaced therefrom when the security collar is in the closed position.

4. The padlockable security collar of claim 1, wherein the third wall formation extends substantially perpendicular to the two spaced-apart wall formations.

5. The padlockable security collar of claim 1, wherein at least one of the two wing formations has an opening formed therethrough that substantially parallels the central axis.

6. The padlockable security collar of claim 1, wherein substantially identically positioned and substantially identically configured holes are formed through each of the two padlockable end formations, with the at least one of the holes formed through one of the padlockable end formations being alignable with at least a corresponding one of the holes formed through the other of the padlockable end formations when the padlockable end formations are in engagement with each other, so a shackle of a padlock can extend through the aligned holes to permit the padlock to lock the two padlockable end formations together.

7. The padlockable security collar of claim 6, wherein the substantially identically configured holes formed through each of the padlockable end formations include two holes formed through each of the padlockable end formations, with the two holes formed through one of the padlockable end formations being alignable with the two holes formed through the other of the padlockable end formations so that a shackle of a padlock can be inserted through one of the two sets of aligned holes, and a threaded fastener can be installed through the other of the two sets of aligned holes to thereby both lock and clamp the padlockable end formations together.

8. The padlockable security collar of claim 1, wherein the arcuate end components define segments of an imaginary circle, with the segments each having a length at least as long as one fourth of the circumference of the imaginary circle.

9. A padlockable security collar consisting of a chain of three elongate components arranged end to end in series, wherein:

two of the three elongate components of the security collar comprises generally arcuate end components of the chain that define end formations which engage when the security collar is in a closed position, and that separate from each other when the security collar is in an open position;

a third of the three components of the security collar comprises an intermediate component of the chain that has a substantially flat, generally rectangular portion that extends between and is pivotally connected to each of the two end components to permit the three components of the chain to pivot about spaced-apart axes that each extends substantially perpendicular to a common plane that reaches substantially centrally through all three of the components of the chain;

the three components of the security collar also are configured to wrap perimetrically around a generally circular central area that can be said to have an imaginary central axis extending therethrough which extends substantially perpendicular to the common plane when the security collar is in the closed position;

the two end components of the security collar separate sufficiently when the security collar is in the open position to permit the security collar to withdraw from surrounding the central area;

the intermediate component of the security collar has an integrally formed portion that either overlies or underlies at least a part of the central area, and that extends generally toward the central axis when the security collar is in the closed position;

the integrally formed portion also defines a pair of wing formations that each reaches toward a different one of the two end components when the security collar is in the closed position; and the integrally formed portion also defines a generally arcuate surface that forms a part of and joins the wing formations, with the generally arcuate surface wrapping part of the way around the central axis at a substantially uniform distance there from when the security collar is in the closed position.

* * * * *